US008826977B2

(12) United States Patent
Herrick

(10) Patent No.: US 8,826,977 B2
(45) Date of Patent: Sep. 9, 2014

(54) REMEDIATION OF RELATIVE PERMEABILITY BLOCKING USING ELECTRO-OSMOSIS

(75) Inventor: David C. Herrick, Cody, WY (US)

(73) Assignee: Baker Hughes Incorporated, Houston, TX (US)

( * ) Notice: Subject to any disclaimer, the term of this patent is extended or adjusted under 35 U.S.C. 154(b) by 319 days.

(21) Appl. No.: 12/857,091

(22) Filed: Aug. 16, 2010

(65) Prior Publication Data

US 2011/0042141 A1 Feb. 24, 2011

Related U.S. Application Data

(60) Provisional application No. 61/234,901, filed on Aug. 18, 2009.

(51) Int. Cl.

| | |
|---|---|
| ***E21B 47/00*** | (2012.01) |
| ***E21B 49/00*** | (2006.01) |
| ***E21B 49/08*** | (2006.01) |

(52) U.S. Cl.

CPC ..... *E21B 49/08* (2013.01)
USPC ..... 166/250.02; 175/50; 73/152.05

(58) Field of Classification Search

USPC ..... 166/66, 250.02, 242.4; 175/50; 73/152.05, 152.01

See application file for complete search history.

(56) References Cited

U.S. PATENT DOCUMENTS

| | | | | |
|---|---|---|---|---|
| 2,364,957 | A * | 12/1944 | Douglas | 324/356 |
| 2,669,688 | A * | 2/1954 | Doll | 324/367 |
| 2,754,475 | A * | 7/1956 | Norelius | 324/366 |
| 3,186,222 | A * | 6/1965 | Martin | 340/853.7 |
| 3,329,889 | A * | 7/1967 | Tanguy | 324/373 |
| 3,417,823 | A * | 12/1968 | Faris | 166/248 |
| 3,443,639 | A * | 5/1969 | Patterson et al. | 166/288 |
| 3,642,066 | A * | 2/1972 | Gill | 166/248 |
| 3,724,543 | A * | 4/1973 | Bell et al. | 166/248 |
| 3,782,465 | A * | 1/1974 | Bell et al. | 166/248 |
| 3,818,996 | A * | 6/1974 | McCaleb | 175/57 |
| RE29,151 | E * | 3/1977 | McCaleb | 175/57 |
| 5,708,204 | A | 1/1998 | Kasap | |
| 5,803,186 | A | 9/1998 | Berger et al. | |
| 6,214,202 | B1 * | 4/2001 | McNab et al. | 205/687 |
| 6,609,568 | B2 | 8/2003 | Krueger et al. | |
| 7,059,174 | B2 * | 6/2006 | Ranjan et al. | 73/38 |
| 7,448,262 | B2 | 11/2008 | Sheng et al. | |
| 7,448,263 | B2 | 11/2008 | Sheng et al. | |
| 2005/0177309 | A1 * | 8/2005 | Sri Ranjan et al. | 702/2 |
| 2005/0199387 | A1 * | 9/2005 | Wittle et al. | 166/248 |
| 2008/0156534 | A1 * | 7/2008 | Clark et al. | 175/45 |
| 2010/0274490 | A1 * | 10/2010 | Gok et al. | 702/12 |

* cited by examiner

*Primary Examiner* — Brad Harcourt
*Assistant Examiner* — Catherine Loikith
(74) *Attorney, Agent, or Firm* — Mossman Kumar & Tyler PC

(57) ABSTRACT

A bottomhole assembly is provided with a cathode. The cathode produces a static field in the earth formation and by the electroosmotic effect, inhibits the invasion of the formation by borehole fluids and reduces formation damage. The cathode also results in improved estimates of formation permeability using flow tests. A cathode on a wireline string may be used to reduce water saturation in an invaded zone near a borehole.

14 Claims, 6 Drawing Sheets

REMEDIATION OF RELATIVE PERMEABILITY BLOCKING USING ELECTRO-OSMOSIS

CROSS-REFERENCES TO RELATED APPLICATIONS

This application claims priority from U.S. Provisional Patent Application Ser. No. 61/234,901 filed on Aug. 18, 2009.

BACKGROUND OF THE DISCLOSURE

1. Field of the Disclosure

This disclosure relates to the testing of underground formations or reservoirs. More particularly, this disclosure relates to a method of reducing formation damage due to invasion of brine during drilling and/or hydraulic fracturing and for making more reliable estimates of formation permeability using prior art methods and apparatus.

2. Description of the Related Art

To obtain hydrocarbons such as oil and gas, boreholes are drilled by rotating a drill bit attached at a drill string end. A large proportion of the current drilling activity involves directional drilling, i.e., drilling deviated and horizontal boreholes to increase the hydrocarbon production and/or to withdraw additional hydrocarbons from the earth's formations. Modern directional drilling systems generally employ a drill string having a bottomhole assembly (BHA) and a drill bit at an end thereof that is rotated by a drill motor (mud motor) and/or by rotating the drill string. A number of downhole devices placed in close proximity to the drill bit measure certain downhole operating parameters associated with the drill string. Such devices typically include sensors for measuring downhole temperature and pressure, azimuth and inclination measuring devices and a resistivity-measuring device to determine the presence of hydrocarbons and water. Additional down-hole instruments, known as logging-while-drilling (LWD) tools, are frequently attached to the drill string to determine the formation geology and formation fluid conditions during the drilling operations.

Drilling fluid (commonly known as the "mud" or "drilling mud") is pumped into the drill pipe to rotate the drill motor, provide lubrication to various members of the drill string including the drill bit and to remove cuttings produced by the drill bit. The drill pipe is rotated by a prime mover, such as a motor, to facilitate directional drilling and to drill vertical boreholes. The drill bit is typically coupled to a bearing assembly having a drive shaft, which in turn rotates the drill bit attached thereto. Radial and axial bearings in the bearing assembly provide support to the radial and axial forces of the drill bit.

Boreholes are usually drilled along predetermined paths and the drilling of a typical borehole proceeds through various formations. The drilling operator typically controls the surface-controlled drilling parameters, such as the weight on bit, drilling fluid flow through the drill pipe, the drill string rotational speed and the density and viscosity of the drilling fluid to optimize the drilling operations. The downhole operating conditions continually change and the operator must react to such changes and adjust the surface-controlled parameters to optimize the drilling operations. For drilling a borehole in a virgin region, the operator typically has seismic survey plots which provide a macro picture of the subsurface formations and a pre-planned borehole path. For drilling multiple boreholes in the same formation, the operator also has information about the previously drilled boreholes in the same formation.

Typically, the information provided to the operator during drilling includes borehole pressure and temperature and drilling parameters, such as Weight-On-Bit (WOB), rotational speed of the drill bit and/or the drill string, and the drilling fluid flow rate. In some cases, the drilling operator also is provided selected information about the bottom hole assembly condition (parameters), such as torque, mud motor differential pressure, torque, bit bounce and whirl etc.

Downhole sensor data are typically processed downhole to some extent and telemetered uphole by sending a signal through the drill string, or by mud-pulse telemetry which is transmitting pressure pulses through the circulating drilling fluid. Although mud-pulse telemetry is more commonly used, such a system is capable of transmitting only a few (1-4) bits of information per second. Due to such a low transmission rate, the trend in the industry has been to attempt to process greater amounts of data downhole and transmit selected computed results or "answers" uphole for use by the driller for controlling the drilling operations.

Commercial development of hydrocarbon fields requires significant amounts of capital. Before field development begins, operators desire to have as much data as possible in order to evaluate the reservoir for commercial viability. Despite the advances in data acquisition during drilling using the MWD systems, it is often necessary to conduct further testing of the hydrocarbon reservoirs in order to obtain additional data. Therefore, after the well has been drilled, the hydrocarbon zones are often tested with other test equipment.

A problem commonly encountered with prior art devices is due to the invasion of the formation by borehole fluids. It is common practice during drilling operations to maintain the borehole fluid pressure slightly above the expected formation fluid pressure. By maintaining this overbalanced condition, the risk of blowouts is reduced. However, with this overbalanced condition, there is a likelihood of the borehole fluid invading the formation. When the borehole fluid is a water-based mud, the invasion of the formation by water can cause formation damage as well as errors in the formation evaluation.

This is illustrated in FIG. 5 where a number of grains 501 of the formation are shown. The formation itself may include a hydrocarbon such as oil or gas, denoted by 505. Many of the common minerals that make up earth formations are preferentially wetted by water. This is illustrated by the water coating 503 surrounding the grains. The water coating may form a continuous film 521 around the grains, impeding the flow of hydrocarbons 505 in the pore spaces such as 509 between the grains towards the borehole (direction indicated by 511). In this regards, it is useful to review certain definitions of permeability from the Schlumberger Oilfield Glossary.

The term "permeability" is defined as

> "The ability, or measurement of a rock's ability, to transmit fluids, typically measured in darcies or millidarcies. Formations that transmit fluids readily, such as sandstones, are described as permeable and tend to have many large, well-connected pores. Impermeable formations, such as shales and siltstones, tend to be finer grained or of a mixed grain size, with smaller, fewer, or less interconnected pores. Absolute permeability is the measurement of the permeability conducted when a single fluid, or phase, is present in the rock."

The term "effective permeability" is defined as "The ability to preferentially flow or transmit a particular fluid when other immiscible fluids are present in the reservoir (e.g., effective permeability of gas in a gas-water reservoir)." Thus, a permeability measuring device would be measuring the effective permeability of a hydrocarbon in a situation such as that shown in FIG. 5, where there is water coating the grains due to the effect of invasion. The presence of the water around the matrix grains can have a large effect in reducing the effective permeability of tight gas sands.

The change in effective permeability can also have a significant effect on reservoir testing and evaluation. One type of post-drilling test involves producing fluid from the reservoir, shutting-in the well, collecting samples with a probe or dual packers, reducing pressure in a test volume and allowing the pressure to build-up to a static level. This sequence may be repeated several times at several different depths or point within a single reservoir and/or at several different reservoirs within a given borehole. One of the important aspects of the data collected during such a test is the pressure build-up information gathered after drawing the pressure down. From these data, information can be derived as to permeability, and size of the reservoir. Further, actual samples of the reservoir fluid must be obtained, and these samples must be tested to gather Pressure-Volume-Temperature and fluid properties such as density, viscosity and composition.

In order to perform these important tests, some systems require retrieval of the drill string from the borehole. Thereafter, a different tool, designed for the testing, is run into the borehole. A wireline is often used to lower the test tool into the borehole. The test tool sometimes utilizes packers for isolating the reservoir. Numerous communication devices have been designed which provide for manipulation of the test assembly, or alternatively, provide for data transmission from the test assembly. Some of those designs include mud-pulse telemetry to or from a downhole microprocessor located within, or associated with the test assembly. Alternatively, a wire line can be lowered from the surface, into a landing receptacle located within a test assembly, establishing electrical signal communication between the surface and the test assembly. Regardless of the type of test equipment currently used, and regardless of the type of communication system used, the amount of time and money required for retrieving the drill string and running a second test rig into the hole is significant. Further, if the hole is highly deviated, a wire line can not be used to perform the testing, because the test tool may not enter the hole deep enough to reach the desired formation.

U.S. Pat. No. 5,803,186 to Berger et al and U.S. Pat. No. 6,609,568 to Krueger et al., having the same assignee as the present disclosure and the contents of which are incorporated herein by reference, disclose MWD systems that includes use of pressure and resistivity sensors with the MWD system, to allow for real time data transmission of those measurements. The devices disclosed in Berger and in Krueger allow obtaining static pressures, pressure build-ups, and pressure drawdowns with the work string, such as a drill string, in place. Also, computation of permeability and other reservoir parameters based on the pressure measurements can be accomplished without pulling the drill string.

Referring to FIG. 1, prior art methods typically include reducing pressure in a flow line that is in fluid communication with a borehole wall. In Step 2, a piston is used to increase the flow line volume thereby decreasing the flow line pressure. The rate of pressure decrease is such that formation fluid entering the flow line combines with fluid leaving the flow line to create a substantially linear pressure decrease. A "best straight line fit" is used to define a straight-line reference for a predetermined acceptable deviation determination. The acceptable deviation shown is 2σ from the straight line. Once the straight-line reference is determined, the volume increase is maintained at a steady rate. At a time $t_1$, the pressure exceeds the 2σ limit and it is assumed that the flow line pressure being below the formation pressure causes the deviation. At $t_1$, the drawdown is discontinued and the pressure is allowed to stabilize in Step 3. At $t_2$, another drawdown cycle is started which may include using a new straight-line reference. The drawdown cycle is repeated until the flow line stabilizes at a pressure twice. Step 5 starts at $t_4$ and shows a final drawdown cycle for determining permeability of the formation. Step 5 ends at $t_5$ when the flow line pressure builds up to the borehole pressure Pm. With the flow line pressure equalized to the borehole pressure, the chance of sticking the tool is reduced. The tool can then be moved to a new test location or removed from the borehole. Methods for analyzing flow tests to estimate permeability are disclosed, for example, in U.S. Pat. No. 5,708,204 to Kasap, having the same assignee as the present disclosure and the contents of which are incorporated herein by reference. Methods for analyzing flow tests in anisotropic formation to estimate horizontal and vertical permeabilities are disclosed in U.S. Pat. No. 7,448,263 to Sheng et al. and in U.S. Pat. No. 7,448,262 to Sheng et al., having the same assignee as the present disclosure and the contents of which are incorporated herein by reference.

For reservoir development, the absolute permeability is of particular interest as it measures the ability of the hydrocarbons to flow into a well in the absence of other fluids. For this reason, measurements of effective permeability by prior art devices always underestimate the ability of a reservoir to produce hydrocarbons. The present disclosure is directed towards a method and apparatus for measuring a permeability that is closer to the absolute permeability than can be obtained with prior art devices, and with reducing the effect of formation damage.

SUMMARY OF THE DISCLOSURE

One embodiment of the disclosure is a system configured to conduct drilling operations of an earth formation. The system includes: a bottomhole assembly (BHA) configured to be conveyed by a drilling tubular in a borehole in the earth formation; a drillbit on the BHA configured to drill a borehole; and a cathode associated with the BHA configured to produce a static electric field in the earth formation and inhibit a flow of water from the borehole into the earth formation.

Another embodiment of the disclosure is a method of conducting drilling operations. The method includes: conveying a drillbit on a bottomhole assembly conveyed in a borehole; and using a cathode proximate to the probe to produce a static electric field in the earth formation and inhibit a flow of water from the borehole into the earth formation.

Another embodiment of the disclosure is a system configured to evaluate an earth formation. The system includes: a cathode configured to produce a static electric field in the earth formation and remove water from an invaded zone in the earth formation.

Another embodiment of the disclosure is a method of evaluating an earth formation. The method includes: using a probe conveyed in a borehole on a wireline for conducting a fluid flow test; using a cathode associated with the probe for producing a static electric field in the formation and removing water from an invaded zone in the formation; using a processor for estimating a permeability of the earth formation using a result of the flow test; and conducting additional reservoir development operations using the estimated permeability.

BRIEF DESCRIPTION OF THE DRAWINGS

The novel features of this disclosure, as well as the disclosure itself, will be best understood from the attached drawings, taken along with the following description, in which similar reference characters refer to similar parts, and in which.

DETAILED DESCRIPTION OF DISCLOSURE

Figure 1:
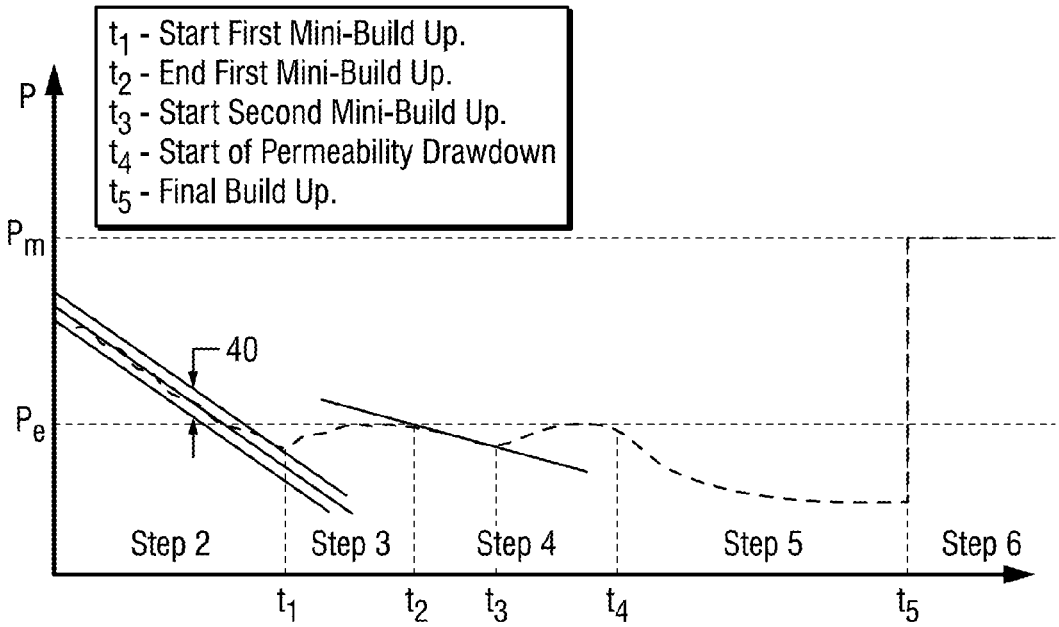
FIG. 1 (Prior Art)
FIG. 1 (prior art) is a graphical qualitative representation a formation pressure test using a particular prior art method.

Prior art methods have been used to increase the flow of water into a borehole to remove contaminants from soil. The system of FIG. 2 comprises two electrodes 201 and 202 having opposite polarities and comprising respective, mutually facing planar surfaces 203 and 204. A first face 207 of a generally thin porous medium 205 is applied to the surface 204 of the electrode 202, and a generally thin layer of soil 206 to be decontaminated is placed between a second surface 208 of the porous medium 205 and the surface 203 of the electrode 201. A presaturated porous membrane 209 is interposed between the layer of soil 206 and the surface 203 of the electrode 201. The material of the porous medium is a continuous and flexible material but could also be a particular or granular material separated from the soil by a porous membrane.

Figure 2:
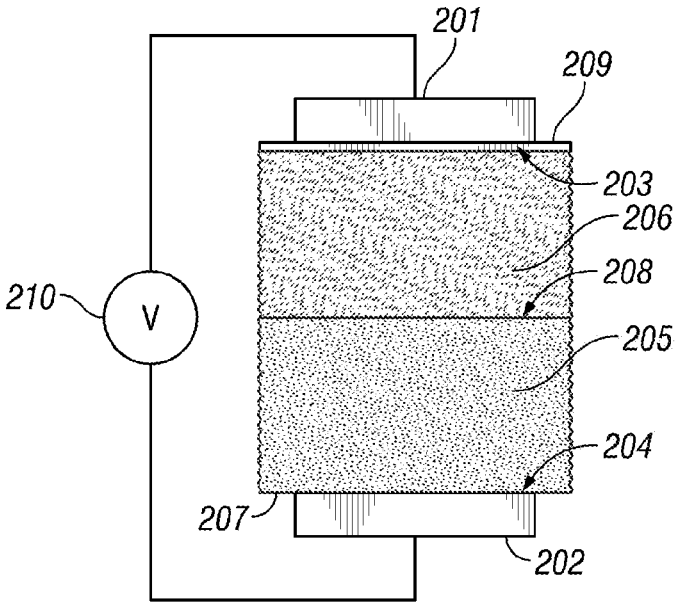
FIG. 2 (Prior Art)
FIG. 2 (prior art) is an example of an apparatus used to remove contaminants from a layer of soil.

A voltage source 210 applies an electric potential (voltage V) to the electrodes 201 and 202. In the system of FIG. 2, the electrode 201 is the anode and the electrode 202 is the cathode. Therefore, the thin layer of soil 206 constitutes an anodic zone and the porous medium 205 a cathodic zone. Due to electro-osmosis, the pore fluid in the soil moves from the anode 201 to the cathode 202. The positive ions also move from the anode 201 to the cathode 202.

In response to the electric potential (voltage V), the $H^+$ ions produced by electrolysis of the soil water at the contact soil-anode will move away from the anode 201 and penetrate into the soil (anodic zone), lowering the soil pH and enhancing the solubilization of certain contaminants like heavy metals. In addition to the electro-osmotic flow, the applied electric potential V will force the migration of all cations in the solution, including heavy metals from the anode 201 to the cathode 202, whereby these cations will be transferred to the porous medium (cathodic zone) 205. Due to the above described electro-osmotic flow and ionic movement, the contaminants are transferred from the layer of soil (anodic zone) 206 to the porous medium (cathodic zone) 205 and there is a flow of water towards the cathode. The principles of electro-osmosis described above are used in the present disclosure to reducing brine content of the invaded zone near the borehole instead of enhancing the flow of water towards the borehole as in prior art.

Figure 3:
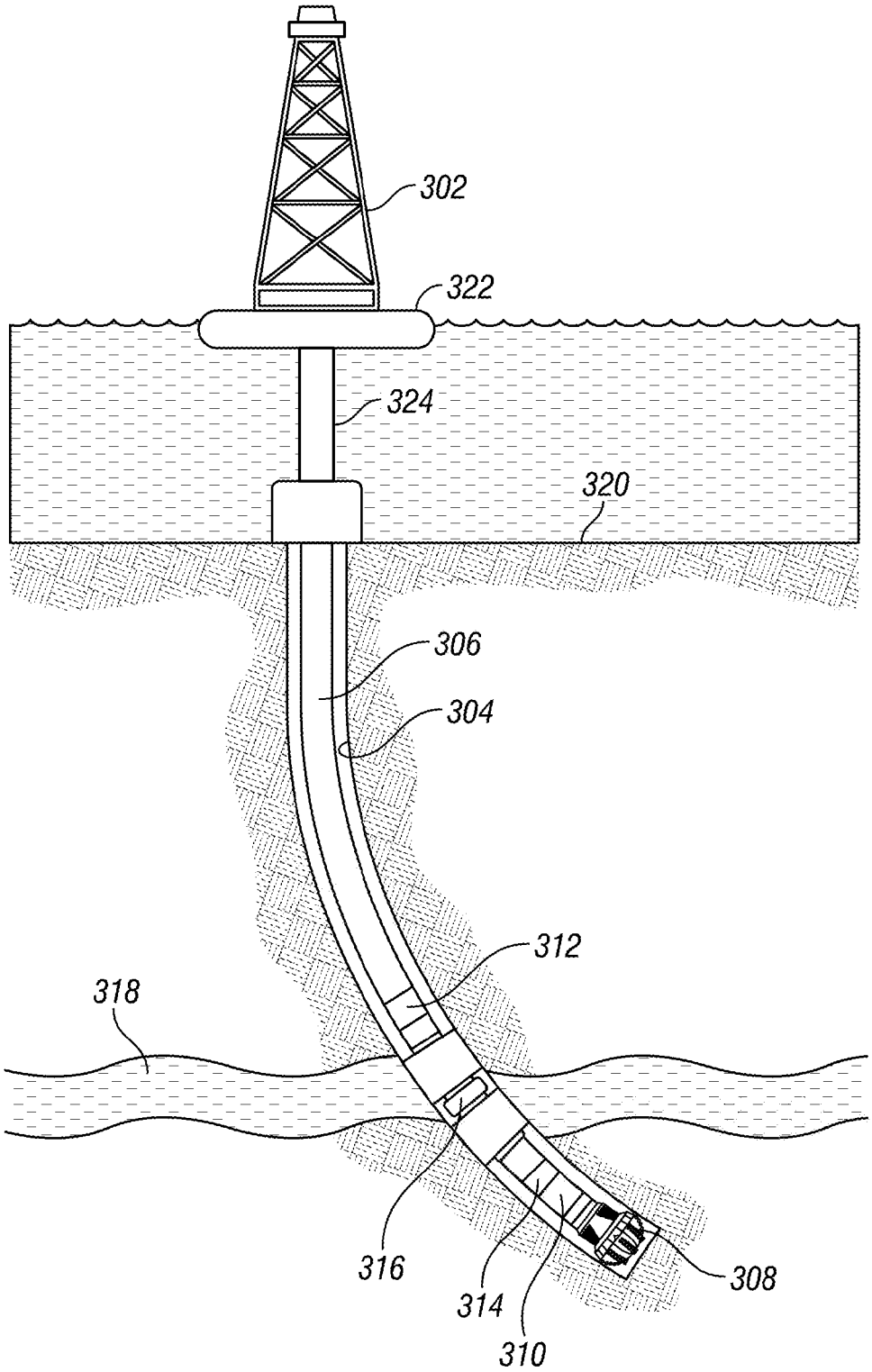
FIG. 3 is an elevation view of an offshore drilling system according to one embodiment of the present disclosure.

FIG. 3 is a drilling apparatus according to one embodiment of the present disclosure. A typical drilling rig 302 with a borehole 304 extending therefrom is illustrated, as is well understood by those of ordinary skill in the art. The drilling rig 302 has a work string 306, which in the embodiment shown is a drill string. The drill string 306 has attached thereto a drill bit 308 for drilling the borehole 304. The present disclosure is also useful in other types of work strings, and it is useful with a wireline, jointed tubing, coiled tubing, or other small diameter work string such as snubbing pipe. The drilling rig 302 is shown positioned on a drilling ship 322 with a riser 324 extending from the drilling ship 322 to the sea floor 320. However, any drilling rig configuration such as a land-based rig may be adapted to implement the present disclosure.

If applicable, the drill string 306 can have a downhole drill motor 310. Incorporated in the drill string 306 above the drill bit 308 is a typical testing unit, which can have at least one sensor 314 to sense downhole characteristics of the borehole, the bit, and the reservoir, with such sensors being well known in the art. A useful application of the sensor 314 is to determine direction, azimuth and orientation of the drill string 306 using an accelerometer or similar sensor. The BHA also contains the formation test apparatus 316 of the present disclosure, which will be described in greater detail hereinafter. A telemetry system 312 is located in a suitable location on the work string 306 such as above the test apparatus 316. The telemetry system 312 is used for command and data communication between the surface and the test apparatus 316.

Figure 4:
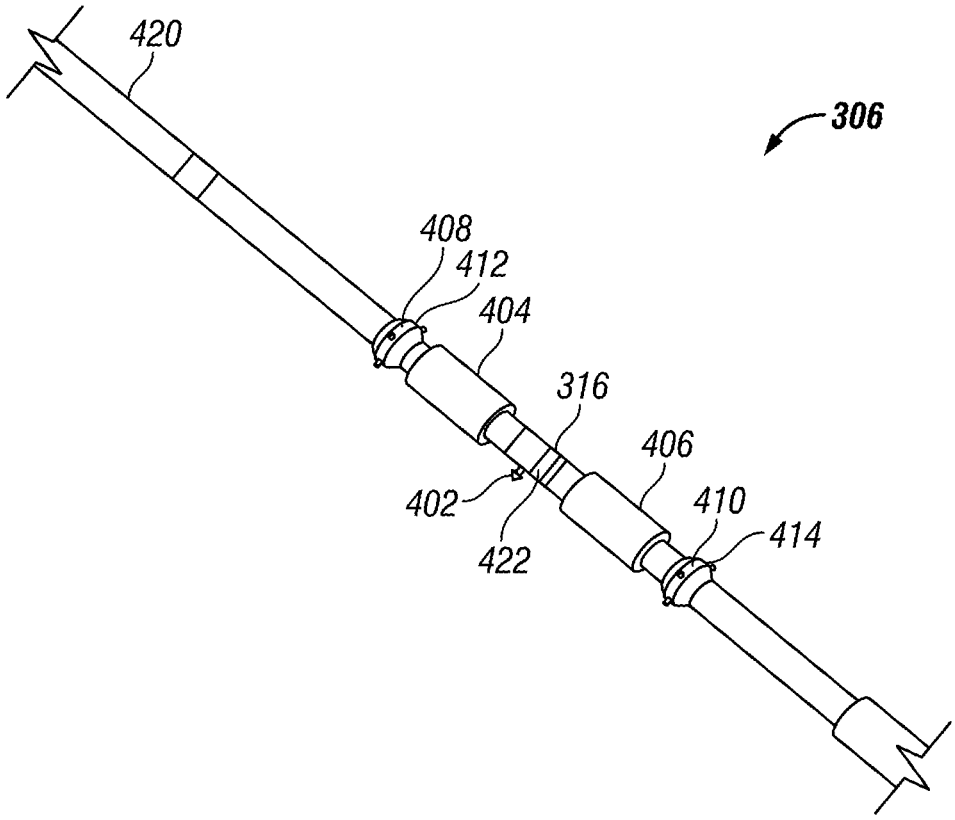
FIG. 4 shows a portion of drill string incorporating the present disclosure.

FIG. 4 is a section of drill string 306 incorporating the present disclosure. The tool section may be located in a BHA close to the drill bit (not shown). Much of the design and use of the tool is described in U.S. Pat. No. 6,609,568 to Krueger et al., having the same assignee as the present disclosure and the contents of which are incorporated herein by reference. The tool includes a communication unit and power supply 420 for two-way communication to the surface and supplying power to the downhole components. In one embodiment, the tool requires a signal from the surface only for test initiation. A downhole controller and processor (not shown) carry out all subsequent control. The power supply may be a generator driven by a mud motor (not shown) or it may be any other suitable power source. Also included are multiple stabilizers 408 and 410 for stabilizing the tool section of the drill string 306 and packers 404 and 406 for sealing a portion of the annulus. A circulation valve disposed above the upper packer 404 is used to allow continued circulation of drilling mud above the packers 404 and 406 while rotation of the drill bit is stopped. A separate vent or equalization valve (not shown) is used to vent fluid from the test volume between the packers 404 and 406 to the upper annulus. This venting reduces the test volume pressure, which is required for a drawdown test. It is also contemplated that the pressure between the packers 404 and 406 could be reduced by drawing fluid into the system or venting fluid to the lower annulus, but in any case some method of increasing the volume of the intermediate annulus to decrease the pressure will be required.

In one embodiment of the present disclosure an extendable pad-sealing element 402 for engaging the borehole wall is disposed between the packers 404 and 406 on the test apparatus 316. The pad-sealing element 402 could be used without the packers 404 and 406, because a sufficient seal with the well wall can be maintained with the pad 402 alone. If packers 404 and 406 are not used, a counterforce is required so pad 402 can maintain sealing engagement with the wall of the borehole 304. The seal creates a test volume at the pad seal and extending only within the tool to the pump rather than also using the volume between packer elements.

One way to ensure the seal is maintained is to ensure greater stability of the drill string 306. Selectively extendable gripper elements 412 and 414 could be incorporated into the drill string 306 to anchor the drill string 306 during the test. The grippers 412 and 414 are shown incorporated into the stabilizers 408 and 410 in this embodiment. The grippers 412 and 414, which would have a roughened end surface for engaging the well wall, would protect soft components such as the pad-sealing element 402 and packers 404 and 406 from damage due to tool movement. The grippers 412 would be especially desirable in offshore systems such as the one shown in FIG. 3, because movement caused by heave can cause premature wear out of sealing components.

In practice, after sealing off the annulus, the test device (probe) 316 withdraws fluid from the annulus and monitors the pressure and the flow rate as discussed, for example, in Krueger. A typical sequence is illustrated in FIG. 1. It should be noted that while FIG. 4 shows a device configured for MWD use, similar apparatus and methods could be used with a wireline.

In normal drilling, after drilling or fracturing with water or water-based fluids invasion can occur around the hole or fracture due to over-balanced pressure conditions. Invasion increases the water saturation in the invaded zone and changes the relative permeability to both water and oil or gas. Generally the hydrocarbon permeability is reduced, even to zero. Relative permeability blockage due to invasion can be particularly difficult to remedy in low permeability formations such as tight gas sands. To deal with the problem of "permeability blockage", the tool 306 is also provided with a cathode 420. The cathode may be a ring cathode as shown. While the cathode is show on the probe, other locations are possible. For example, the cathode may be positioned on a drillstring, on the BHA, on another wireline tool, and, in the case of a cased hole, on the casing. The anode is provided at a remote location, in good electrical communication with the cathode through the formation. This could be at another borehole, a mud pit at the surface, or the base of the drilling platform.

The surfaces of minerals, particularly silicate minerals are negatively charged at about pH 6 or higher. The negative charge is compensated by cations from brine in the pore system. The cations migrate along the mineral surfaces when subjected to an electric field and drag the pore water with them. In contrast to flow due to a pressure differential, electroosmotic flow is generated throughout the rock in the electric field and the effect is increased with higher surface to volume ratio.

Figure 5:
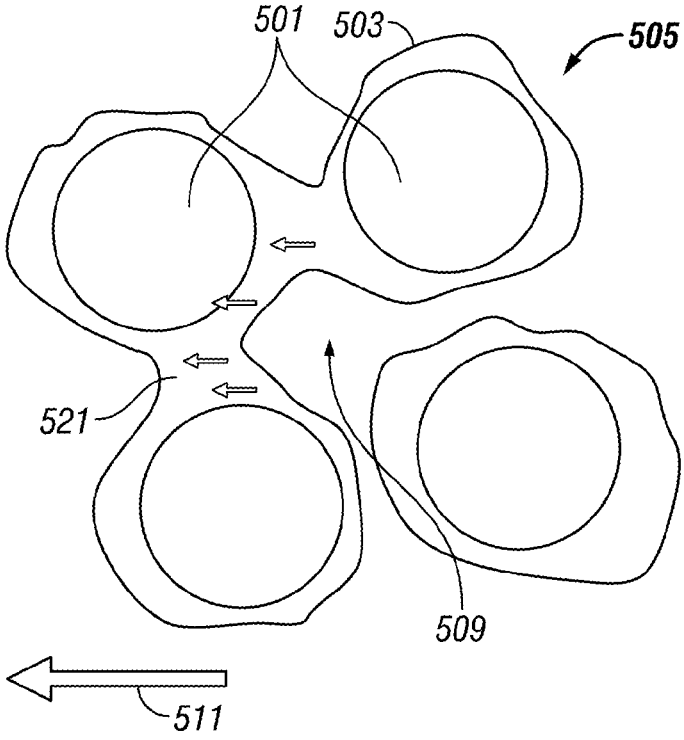
FIG. 5 illustrates the effect of fluid invasion on the flow of hydrocarbons.
Figure 6:
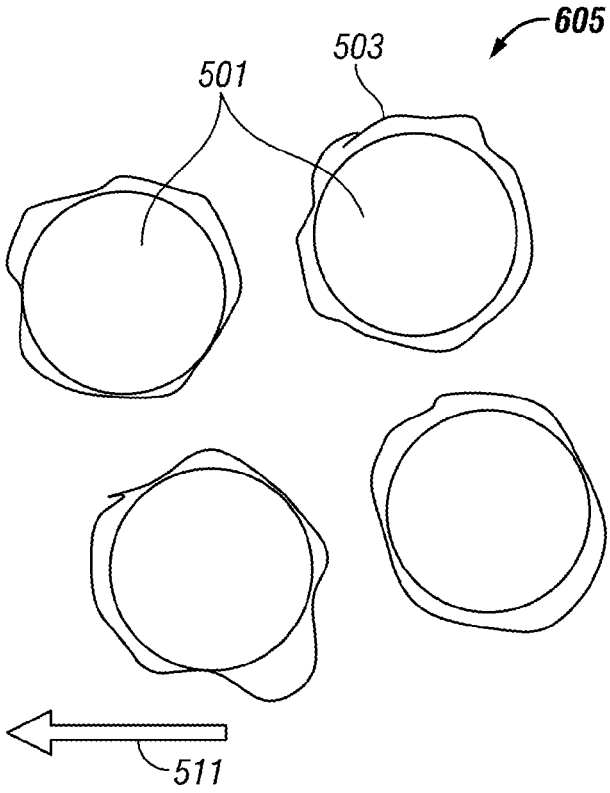
FIG. 6 shows the improved mobility of hydrocarbons using the present method.

This is schematically illustrated in FIG. 6. Compared to FIG. 5, it can be seen that the water 503 coating the mineral grains 501 is greatly reduced in thickness and thus presents less of an obstacle to flow of hydrocarbons 605. When the electric current is established, water in the invaded zone will move toward the borehole containing the cathode. The reduction of water saturation in the invaded zone will increase the relative permeability and the effective permeability of hydrocarbons.

Figure 7:
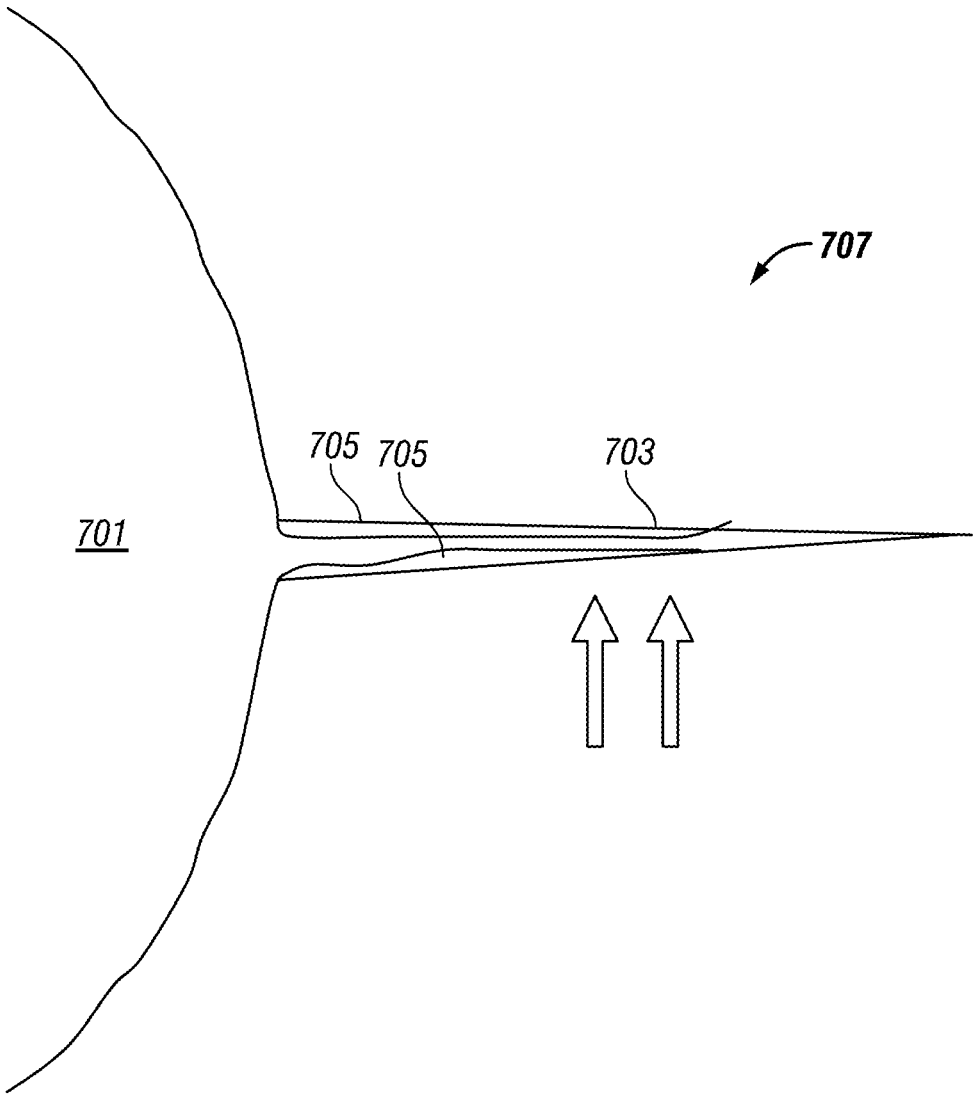
FIG. 7 shows the effect of fluid invasion on a fracture.

The benefit of the present disclosure for fracturing in illustrated in FIG. 7. Shown is a vertical fracture 703 that may be produced by fracturing a formation. It is inherent in such fracturing operations to use a borehole 701 fluid pressure that exceeds the formation fluid pressure, so that invasion of the formation occurs and, in particular, the fracture is coated with water as shown by 705. Since the purpose of fracturing may be to increase the flow of hydrocarbons indicated by 707 into the fracture, a thin layer of water 705 in the fracture greatly reduces the effective permeability. By using the method of the present disclosure, the water layer is reduced and the permeability measured by the flow tests is increased.

The results of a flow test using a testing apparatus including a cathode as discussed above can be analyzed using the methods discussed in prior art, e.g., by Kasap for isotropic formations and by Sheng et al. for anisotropic formations.

Those versed in the art and having benefit of the present disclosure would recognize that the cathode 420 need not be part of a formation pressure testing tool and could be used on the BHA for the purposes of reducing formation damage. In this regard, it would be desirable to have the cathode as close to the drillbit 318 as possible, so that the benefit of the reduced migration of borehole fluid is maximized.

The determined formation permeabilities may be recorded on a suitable medium and used for subsequent processing upon retrieval of the BHA. The determined formation permeabilities may further be telemetered uphole for display and analysis.

Figure 8:
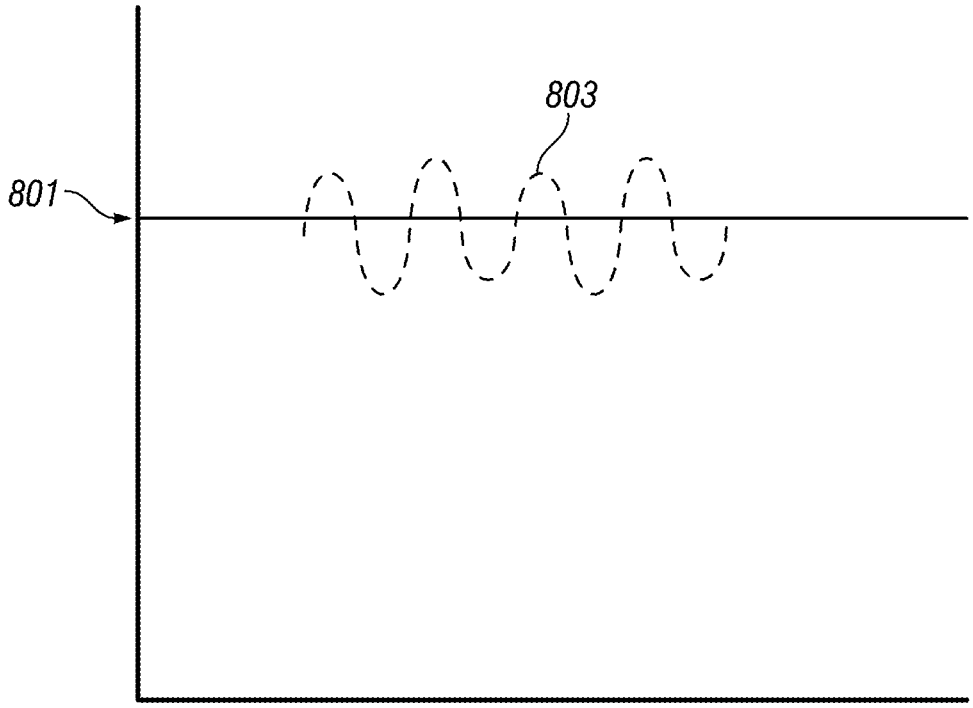
FIG. 8 shows an alternating current added to the DC voltage of the cathodes.

One embodiment of the disclosure also envisages that in addition to the DC voltage, an alternating current of smaller magnitude than the DC voltage is applied to the cathode. This is illustrated in FIG. 8 by the AC voltage 803 added to the DC voltage 801. The effect of the AC voltage is to produce an alternating electroosmotic motion of the water 503 that loosens the attachment of the water to the grains 501, so that it is easier for the DC voltage to move the water towards the borehole.

In another embodiment of the disclosure, the remediation of formation damage may be done while tripping out of the borehole. The natural pauses involved in removing sections of drill pipe provide some time in which the static field produced by the cathode can reduce the water in invaded zones.

Implicit in the control and processing of the data is the use of a computer program implemented on a suitable machine readable medium that enables the processor to perform the control and processing. The machine readable medium may include ROMs, EPROMs, EAROMs, Flash Memories and Optical disks.

The foregoing description is directed to particular embodiments of the present disclosure for the purpose of illustration and explanation. It will be apparent, however, to one skilled in the art that many modifications and changes to the embodiment set forth above are possible without departing from the scope and the spirit of the disclosure. It is intended that the following claims be interpreted to embrace all such modifications and changes.

What is claimed is:

1. A system configured to conduct drilling operations of an earth formation, the system comprising:

a bottomhole assembly (BHA) configured to be conveyed by a drilling tubular in a borehole in the earth formation;

a drillbit on the BHA configured to drill a borehole;

a circulating water-based borehole fluid in the borehole at overbalanced pressure surrounding the BHA; and a cathode associated with the BHA configured to produce a static electric field in the earth formation;

wherein the water-based borehole fluid comprises sufficient cations to bias the water-based borehole fluid toward the cathode and inhibit fluid invasion of the water-based borehole fluid into the earth formation from the borehole.

2. The system of claim 1 further comprising:

a probe configured to make a fluid flow test in the borehole; and a processor configured to estimate a permeability of the earth formation from analysis of a flow test made by the probe.

3. The system of claim 1 further comprising an anode at a location selected from: (i) another borehole, (ii) a mud pit, and (iii) a base of a drilling platform.

4. The system of claim 1 wherein a probe is on the BHA.

5. The system of claim 4 wherein the BHA is further configured to produce a fracture in the earth formation and wherein the cathode inhibits coating of a wall of the fracture with water from the borehole.

6. The system of claim 1 wherein the cathode is positioned on one of: (i) a drill string, and (ii) the bottomhole assembly.

7. The system of claim 1 wherein the cathode is further configured to provide an alternating electric field and reduce the attachment of water to grains of the formation.

8. A method of conducting drilling operations, the method comprising:

conveying a drillbit on a bottomhole assembly conveyed in a borehole;

conducting overbalanced drilling operations; and using a cathode proximate to a probe to produce a static electric field in an earth formation during overbalanced drilling operations biasing a circulating water-based borehole fluid toward the cathode and inhibiting fluid invasion of the water-based borehole fluid into the earth formation from the borehole.

9. The method of claim 8 further comprising:

making a fluid flow test using the probe conveyed in the borehole; and estimating a permeability of the earth formation from analysis of a flow test made by the probe.

10. The method of claim 9 further comprising positioning an anode at a location selected from:

(i) another borehole, (ii) a mud pit, and (iii) a base of a drilling platform.

11. The method of claim 10 further comprising using the BHA to produce a fracture in the earth formation and using the static electric field to reduce a flow of water from the borehole into the fracture.

12. The method of claim 9 further comprising positioning the probe on the BHA.

13. The method of claim 8 further comprising positioning the cathode on one of: (i) a drill string, and (ii) the bottomhole assembly.

14. The method of claim 8 further comprising providing the cathode with an alternating electric field.

* * * * *